US007938867B2

(12) United States Patent
Spivey et al.

(10) Patent No.: US 7,938,867 B2
(45) Date of Patent: May 10, 2011

(54) FUEL COMPOSITION CONTAINING A MEDIUM SUBSTANTIALLY FREE OF SULPHUR AND PROCESS THEREOF

(75) Inventors: David L. Spivey, Staffordshire (GB); Robert H. Barbour, Derbyshire (GB); William B. Chamberlin, III, Kirtland, OH (US); John K. Pudelski, Cleveland Heights, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 531 days.

(21) Appl. No.: 11/852,459

(22) Filed: Sep. 10, 2007

(65) Prior Publication Data

US 2008/0000147 A1 Jan. 3, 2008

Related U.S. Application Data

(62) Division of application No. 10/774,849, filed on Feb. 9, 2004, now Pat. No. 7,402,186.

(51) Int. Cl.
*C10L 1/10* (2006.01)
*C10L 1/18* (2006.01)

(52) U.S. Cl. ..... 44/300; 44/388; 44/413; 44/439; 44/447; 44/451

(58) Field of Classification Search ..... 44/300, 44/388, 439, 447, 451, 413
See application file for complete search history.

(56) References Cited

U.S. PATENT DOCUMENTS

| | | | | |
|---|---|---|---|---|
| 3,658,494 | A | 4/1972 | Dorer, Jr. | 44/63 |
| 5,279,626 | A | 1/1994 | Cunningham et al. | 44/331 |
| 5,916,825 | A | 6/1999 | Cherpeck | 44/347 |
| 6,408,812 | B1 | 6/2002 | Chamberlin, III et al. R | 123/196 |
| 7,413,583 | B2 * | 8/2008 | Langer et al. | 44/301 |
| 2002/0151756 | A1 * | 10/2002 | Schilowitz et al. | 585/14 |
| 2004/0068922 | A1 * | 4/2004 | Barbour et al. | 44/418 |

FOREIGN PATENT DOCUMENTS

| | | |
|---|---|---|
| EP | 0476196 | 3/1992 |
| WO | WO 98/12282 | 3/1998 |
| WO | WO 98/42808 | 10/1998 |
| WO | WO 02/06428 | 1/2002 |
| WO | WO 02/102942 | 12/2002 |
| WO | WO 03/083020 | 10/2003 |

OTHER PUBLICATIONS

Corresponding PCT Publication No. WO 2005/078052 and Search Report published Aug. 25, 2005.

* cited by examiner

*Primary Examiner* — Cephia D Toomer
(74) *Attorney, Agent, or Firm* — Christopher D. Hilker; David M. Shold

(57) ABSTRACT

A fuel composition contains (a) a medium substantially free of to free of sulphur; (b) a detergent/dispersant additive; and (c) a liquid fuel where the medium substantially free of to free of sulphur is an aliphatic hydrocarbon solvent, and where the aliphatic hydrocarbon solvent is present from at least about 50 wt % to about 100 wt % of the total amount of the medium. The fuel composition is prepared by a process and is useful in a process, where the fuel composition includes a medium that is a hydrocarbon or a nonhydrocarbon or a mixture thereof, to increase the efficiency of an exhaust after-treatment device of an internal combustion engine.

10 Claims, No Drawings

FUEL COMPOSITION CONTAINING A MEDIUM SUBSTANTIALLY FREE OF SULPHUR AND PROCESS THEREOF

This is a divisional of application U.S. Ser. No. 10/774,849 filed on Feb. 9, 2004 now U.S. Pat. No. 7,402,186.

BACKGROUND OF THE INVENTION

1. Field of the Invention

The present invention relates to a fuel composition containing (a) a medium substantially free of to free of sulphur; (b) a detergent/dispersant additive; and (c) a liquid fuel. The invention further provides a process for increasing the efficiency of an exhaust after-treatment device of an internal combustion engine and a process for preparing a fuel composition comprising the medium substantially free of to free of sulphur.

2. Description of the Related Art

Global legislation towards a reduction of certain components of exhaust emissions, including $NO_x$ (nitrogen oxides) and particulate matter such as soot and oxides of sulphur, produced by automotive engines has resulted in a decrease in the sulphur content of fuel such as diesel fuel and gasoline since the sulphur upon combustion produces highly acidic products and can interfere with the functioning of exhaust after-treatment devices of internal combustion engines. In many countries the sulphur content of fuel has been or is being decreased to less than about 50 ppm and newer fuels have even lower sulphur contents of about 20 ppm or less. Fuels with a sulphur content of about 20 ppm or less are often referred to as ultra-low sulphur fuels.

Furthermore in an attempt to meet emissions targets, automotive manufacturers are developing exhaust after-treatment devices to further reduce emissions. These exhaust after-treatment devices are known to be susceptible to sulphur poisoning even at low sulphur concentrations from sulphur-containing components evolved during fuel combustion. As a consequence of sulphur poisoning, exhaust after-treatment devices may be less efficient which can decrease the performance of the engine and can increase the amounts of regulated components, such as $NO_x$ and particulate matter and hydrocarbons and carbon monoxide, emitted from the exhaust of the engine.

The patent literature is replete with disclosures of fuel compositions comprising mediums and detergent/dispersant additives.

Duncan et al. in International Publication No. WO 02/06428A1 disclose an additive composition for improving middle distillate fuel oils that comprises a hydrocarbyl-substituted monosuccinimide dispersant and an oil having a viscosity at 40° C. of about 100 to about 400 centistokes.

Wallace in European Publication No. EP 0476196A1 discloses a fuel composition having improved combustion characteristics that comprises a liquid hydro-carbonaceous fuel, a manganese carbonyl compound, an alkali or alkaline earth metal containing detergent, an ashless dispersant and optionally other components.

International Publication WO 98/12282 A1 discloses a detergent additive composition for diesel fuel that contains a polyisobutylene monosuccinimide in an aromatic hydrocarbon diluent. The detergent additive composition can be used to remove or prevent engine deposits.

U.S. Pat. No. 5,279,626 discloses an additive package with an enhanced shelf-life stability that contains (a) a dispersant/detergent; (b) a demulsifier; and (c) a solvent stabilizer formed from at least one aromatic hydrocarbon solvent and at least one alcohol.

U.S. Pat. No. 3,658,494 discloses a fuel composition and a solution in a solvent where the fuel composition or solution contains an additive combination comprising an oxy compound and a dispersant. The fuel composition can be prepared from the solution of the oxy compound and dispersant in the solvent. The fuel composition or solution can be used to clean fuel systems in liquid-fuel burning devices such as internal combustion engines.

Chamberlin, III et al. in U.S. Pat. No. 6,408,812 disclose the combining of a used lubricating oil composition with a gasoline fuel composition for consumption by a spark-ignited internal combustion engine having an exhaust gas after-treatment device where the oil composition is free of sulphur, phosphorus, halogens and metals.

When the medium is an aromatic solvent or diluent, such as for example a xylene or toluene which have low flash points, compositions and processes using such a medium can suffer from lower processing temperatures and/or increased flammability risks. In principle higher molecular weight aromatic compounds with higher flash points may be used. However, many of these aromatic compounds have toxicity issues such as being carcinogenic.

It would be desirable to have a composition and process employing a medium that increases the flashpoint of the composition and the safety of the process. The present invention provides such a composition and process.

It would be desirable to have a composition and process employing a medium that decreases toxicity. The present invention provides a such a composition and process.

It would be desirable to have a composition and process employing a medium that increases the efficiency of an exhaust after-treatment device of an internal combustion engine. The present invention provides such a composition and process.

It would be desirable to have a composition and process employing a medium that decreases emission of one or more regulated components from the exhaust of an internal combustion engine. The present invention provides such a composition and process.

It would be desirable to have a composition and process employing a medium that maintains or increases engine cleanliness. The present invention provides such a composition and process.

SUMMARY OF THE INVENTION

The invention provides a fuel composition, comprising:

(a) a medium substantially free of to free of sulphur;

(b) a detergent/dispersant additive; and (c) a liquid fuel wherein the medium substantially free of to free of sulphur is an aliphatic hydrocarbon solvent, and the aliphatic hydrocarbon solvent is present from at least about 50 wt % to about 100 wt % of the total amount of the medium.

The invention further provides a process for increasing the efficiency of an exhaust after-treatment device of an internal combustion engine, comprising:

operating the engine with a fuel composition comprising (a) a detergent/dispersant additive in a medium substantially free of to free of sulphur; and (b) a liquid fuel wherein the contribution of component (a) to the total sulphur content of the fuel composition is less than 20 ppm by weight, and the exhaust after-treatment device is suitable for reducing emissions of at least one member of the group consisting of particulate matter, $NO_x$ gases and mixtures thereof to less than 600 ppm by weight.

The invention further provides a process for preparing a fuel composition, comprising:

(1) mixing (a) a medium substantially free of to free of sulphur; and (b) a hydrocarbyl-substituted acylating agent to form a mixture;

(2) reacting component (b) of the mixture with an amine to form a detergent/dispersant additive; and (3) adding a liquid fuel to the mixture during step (1), to the reactants during step (2), to the detergent/dispersant additive after step (2), or a combination thereof wherein the medium substantially free of to free of sulphur is an aliphatic hydrocarbon solvent, and the aliphatic hydrocarbon solvent is present from at least about 50 wt % to about 100 wt % of the total amount of the medium.

The invention further provides a composition and process capable of decreasing emission of $NO_x$, particulate matter or mixtures thereof from an internal combustion engine having one or more related exhaust after-treatment devices.

The invention further provides a composition and process capable of maintaining or increasing engine cleanliness with reduced sulphur emissions.

DETAILED DESCRIPTION OF THE INVENTION

The invention provides a fuel composition, comprising:

(a) a medium substantially free of to free of sulphur;

(b) a detergent/dispersant additive; and (c) a liquid fuel wherein the medium substantially free of to free of sulphur is an aliphatic hydrocarbon solvent, and the aliphatic hydrocarbon solvent is present from at least about 50 wt % to about 100 wt % of the total amount of the medium.

The medium (a) can contribute to the total sulphur content of the fuel composition depending on the sulphur content of the medium. Since the medium is free or substantially free of sulphur, its contribution to the fuel composition is minor and can on a weight basis be in several embodiments less than about 20 ppm, less than about 15 ppm, less than about 10 ppm, less than about 6 ppm, less than about 2 ppm, or less than about 1 ppm.

Medium Substantially Free of to Free of Sulphur

The medium substantially free of to free of sulphur of the invention (herein-after referred to as "the medium") can also be described as a solvent or a diluent. The medium can be aliphatic, aromatic, or a mixture thereof. The medium can be a hydrocarbon, a nonhydrocarbon such as an alcohol or ester of a carboxylic acid, or a mixture thereof. The medium can be a single solvent or diluent or a mixture of two or more solvents or diluents. In an embodiment of the invention the medium is an aromatic hydrocarbon, and in other embodiments is a mixture of an aliphatic and an aromatic hydrocarbon, a mixture of an aliphatic and aromatic hydrocarbon where the aliphatic hydrocarbon is present at 50% by weight or more, and an aliphatic hydrocarbon.

The term substantially free of to free of sulphur means that the medium contains no or only trace amounts of sulphur. Often the sulphur content of the medium on a weight basis is below about 25 ppm, preferably below about 18 ppm, more preferably below about 10 ppm and most preferably below about 8 or about 4 ppm. In one embodiment the medium substantially free of to free of sulphur has a sulphur content below about 2 ppm by weight. Those skilled in the art will appreciate that the medium can comprise small quantities of compounds with a sulphur content above the ranges given hereinabove provided that total sulphur content of the medium is within the ranges given.

The medium often contains an aliphatic hydrocarbon solvent or diluent present from at least about 50 wt % to about 100 wt %, preferably about 60 wt % to about 100 wt %, more preferably about 70 wt % to about 100 wt %, even more preferably about 80 wt % to about 100 wt % and most preferably about 90 wt % to about 100 wt % of the total amount of the medium. In one embodiment the medium contains an aliphatic hydrocarbon solvent or diluent present at about 7 wt % of the total amount of the medium. In one embodiment the medium contains an aliphatic hydrocarbon solvent or diluent present at about 5 wt % of the total amount of the medium. In one embodiment the medium contains an aliphatic hydrocarbon solvent or diluent present at about 0 wt % of the total amount of the medium.

Often the medium has a boiling point of about 150° C. or higher, preferably about 175° C. or higher, more preferably about 200° C. or higher and most preferably about 225° C. or higher. In one embodiment the boiling point is about 250° C. In one embodiment the boiling point is about 258° C. Those skilled in the art will appreciate that the medium substantially free of to free of sulphur can comprise small quantities of compounds with a boiling point below the ranges given above provided that the boiling point of the medium is within the ranges given.

Often the medium substantially free of to free of sulphur has a flash point of about 90° C. or higher, and in other embodiments of the invention the medium has a flash point of about 105° C. or higher, about 120° C. or higher and about 130° C. or higher. In further embodiments of the invention the medium has a flash point of about 145° C. or higher and about 150° C. or higher. Those skilled in the art will appreciate that the medium can comprise small quantities of compounds with a flash point below the ranges given above provided that the flash point of the medium is within the ranges given. The flash point can be determined by the Pensky Closed Cup method as described in ASTM (American Society For Testing And Materials) Test Method D93.

The medium substantially free of to free of sulphur can comprise an aliphatic solvent or diluent that is an oil of lubricating viscosity. The oil of lubricating viscosity can comprise natural oils, synthetic oils, or mixtures thereof. Natural oils can comprise plant or vegetable oils, animal fats or oils, oils derived from petroleum or coal or shale to include unrefined and refined and rerefined mineral oils, or mixtures thereof. Synthetic oils can comprise poly(olefins) such as poly(alpha-olefins) and olefin copolymers and hydrogenated derivatives thereof, esters of carboxylic acids such as transesterified vegetable oils, and liquid hydrocarbons and oxygenated derivatives thereof by conversion of a synthesis gas by a process such as the Fischer-Tropsch process, or mixtures thereof. In embodiments of the invention the medium substantially free of to free of sulphur is an oil of lubricating viscosity having an aliphatic hydrocarbon content on a weight basis of at least 50 or 60 or 70 or 80 or 90% to 100%. For example an oil of lubricating viscosity could contain 90% aliphatic mineral oil and 10% aromatic mineral oil, or could contain 80% aliphatic mineral oil and 20% vegetable oil. The oil of lubricating viscosity can have a 100° C. kinematic viscosity of 1 to 300 cSt (centistokes), and in other instances can have a 100° C. kinematic viscosity of 1 to 100 cSt, 1 to 9.5 cSt, 1 to 7 cSt, or 3 to 7 cSt. The oil of lubricating viscosity can be an API (American Petroleum Institute) Group II, III, IV, V base oil or mixture thereof. Examples of commercially available aliphatic hydrocarbon solvents or diluents, to include oils of lubricating viscosity, are Pilot™ 140 and Pilot™ 299 and Pilot™ 900 available from Petrochem Carless, Petro-Canada™ 100N, Nexbase™, Yubase™, and 4 to 6 cSt poly (alpha-olefins).

The medium substantially free of to free of sulphur can comprise an aliphatic solvent or diluent that is a low viscosity composition having a 100° C. kinematic viscosity of 1 cSt or less. The low viscosity composition can comprise a petroleum distillate such as a kerosene, an alkane, an alkene, an alcohol, a ketone, an ester of a carboxylic acid, or a mixture thereof. In embodiments of the invention the medium substantially free of to free of sulphur is a low viscosity composition having an aliphatic hydrocarbon content on a weight basis of at least 50 or 60 or 70 or 80 or 90% to 100%. For example the low viscosity composition could be a petroleum distillate having an aliphatic content of 90% and an aromatic content of 10%, or could be 80% aliphatic petroleum distillate and 20% alcohol.

In another embodiment of the invention the medium can comprise an aromatic solvent or diluent to include aromatic hydrocarbons such as toluene, xylenes and alkylated benzenes. Additional examples of commercially available aromatic hydrocarbon solvents or diluents include from Shell Chemical Shellsolv AB™ and from Exxon Chemical the Aromatic™ series of solvents Aromatic™ 100, Aromatic™ 150 and Aromatic™ 200, the Solvesso™ series of solvents Solvesso™ 100, Solvesso™ 150 and Solvesso™ 200, and HAN™ 857.

In the present invention the detergent/dispersant additive and medium can be added to the liquid fuel as separate components or can be added to the liquid fuel where the detergent/dispersant is in the medium. The medium can be present relative to the medium and detergent/dispersant additive combined in an amount from about 1 wt % to about 99 wt %, preferably about 3 wt % to about 80 wt %, more preferably about 5 wt % to about 70 wt % and most preferably about 8 wt % to about 65 wt %. Often the amount of the medium relative to the medium and detergent/dispersant additive combined will be about 10 to 70 wt %, about 15 to 60 wt %, about 20 to 50 wt % or about 25 to 45 wt %. In this invention the weight ratio of detergent/dispersant additive to the medium can be about 1:99 to about 99:1, preferably about 5:95 to about 95:5, more preferably about 25:75 to about 90:10 and most preferably about 45:55 to about 85:15. Examples of typical weight ratios of the detergent/dispersant additive to the medium include 50:50 to 80:20, 55:45 to 75:25, and 60:40 to 70:30.

Detergent/Dispersant Additive

The detergent/dispersant additive of the present invention can contain nitrogen, oxygen, or a mixture thereof. The detergent/dispersant additive of this invention can contain a hydrocarbyl substituent. In an embodiment of this invention the detergent/dispersant additive can contain nitrogen, oxygen or a mixture thereof and a hydrocarbyl substituent. The detergent/dispersant additive can comprise (1) a reaction product of a hydrocarbyl-substituted acylating agent and an amine, (2) a hydrocarbyl-substituted amine, (3) a hydrocarbyl-substituted hydroxy aromatic compound, (4) a Mannich reaction product, or (5) mixtures thereof.

The hydrocarbyl substituent of the detergent/dispersant additive of this invention can have a number average molecular weight of 300 to 5000, and in other instances can have a number average molecular weight of 400 to 3000, 450 to 2000, 450 to 1500, or 300 to 700 and/or 900 to 2500. A hydrocarbyl group is a univalent group that is predominately hydrocarbon in nature but it can have heteroatoms such as oxygen in the hydrocarbon chain and can have attached to the hydrocarbon chain nonhydrocarbon groups to include heteroatoms and heteroatom containing groups such as for example chlorine, a hydroxyl group or an alkoxy group.

The hydrocarbyl-substituted acylating agent is generally derived from a polyolefin and an acylating agent. The polyolefin can be derived from one or more alkenes usually having 2 to 10 carbon atoms to include for example ethylene, propylene, isobutylene and mixtures thereof. The polyolefin can also be derived from mixtures of alkenes and dienes. In an embodiment of the invention the polyolefin is a polyisobutylene, and in other embodiments the polyolefin is a conventional polyisobutylene having a vinylidene isomer content of 25% or less, a highly reactive polyisobutylene having a vinylidene isomer content of 50% or greater, or a mixture of a conventional and a highly reactive polyisobutylene. The acylating agent can comprise an alpha, beta-unsaturated mono- or polycarboxylic acid or derivative thereof, to include anhydrides and esters, such as for example acrylic acid, methyl acrylate, methacrylic acid, maleic acid or anhydride, fumaric acid, itaconic acid or anhydride, or mixtures thereof. The hydrocarbyl substituted acylating agent can be prepared by well known methods to include heating a polyolefin and an acylating agent at elevated temperatures generally from 150 to 250° C. in the presence or absence of a promoter such as the halogen chlorine. In an embodiment of the invention the hydrocarbyl substituted acylating agent is a polyisobutenylsuccinic anhydride. The amine reacted with the hydrocarbyl substituted acylating agent generally has at least one reactive nitrogen to hydrogen or N—H bond. The amine can comprise ammonia, monoamines, polyamines, or mixtures thereof. Monoamines can comprise amines having 1 to 22 carbon atoms such as butylamine and dimethylamine, alkanolamines containing one or more hydroxy groups such as ethanolamine, or mixtures thereof. Polyamines can comprise alkylenediamines and substituted alkylenediamines such as ethylenediamine and N-methylpropylenediamine, polyalkylene polyamines such as tetraethylenepentamine and polyethylene polyamine bottoms, alkanolamines containing one or more hydroxy groups such as 2-(2-aminoethylamino)ethanol, aminoalkyl substituted heterocyclic compounds such as 1-(3-aminopropyl)imidazole and 4-(3-aminopropyl)morpholine, condensates of polyamines with polyhydroxy compounds such as condensates of polyethylene polyamines with tris (hydroxymethyl)aminomethane as described in U.S. Pat. No. 5,653,152, or mixtures thereof. In an embodiment of the invention the amine is a polyethylene polyamine such as tetraethylenepentamine. Methods to prepare the reaction product of the hydrocarbyl-substituted acylating agent and the amine are well known and generally involve heating the reactants at temperatures of 100 to 250° C. while removing reaction water as described in International Publication No. WO02/102942. The ratio of the carbonyl groups of the acylating agent to the reactive and/or basic nitrogen atoms of the amine can be respectively 1:0.5 to 1:3, and in other instances can be 1:1 to 1:2.75, and 1:1.5 to 1:2.5. In an embodiment of the invention the reaction product of a hydrocarbyl-substituted acylating agent and an amine is a reaction product of a polyisobutenylsuccinic anhydride and an amine, and in another embodiment the amine is a polyamine.

The hydrocarbyl substituent of the hydrocarbyl-substituted amine can have a number average molecular weight and be derived from a polyolefin as described above for the reaction product of the hydrocarbyl-substituted acylating agent and amine. In an embodiment of the invention the hydrocarbyl substituent of the hydrocarbyl-substituted amine is derived from a polyisobutylene. The amine of the hydrocarbyl-substituted amine can be an amine as described above for the reaction product of the hydrocarbyl-substituted acylating agent and amine. In an embodiment of the invention the amine of the hydrocarbyl-substituted amine is a polyamine such as ethylenediamine, 2-(2-aminoethylamino)ethanol, or diethylenetriamine. The hydrocarbyl-substituted amine of the present invention can be prepared by several known methods generally involving amination of a derivative of a polyolefin to include a chlorinated polyolefin, a hydroformylated polyolefin, and an epoxidized polyolefin. In an embodiment of the invention the hydrocarbyl substituted amine is prepared by chlorinating a polyolefin such as a polyisobutylene and then reacting the chlorinated polyolefin with an amine such as a polyamine at elevated temperatures of generally 100 to 150° C. as described in U.S. Pat. No. 5,407,453. To improve processing a solvent can be employed, an excess of the amine can be used to minimize cross-linking, and an inorganic base such as sodium carbonate can be used to aid in removal of hydrogen chloride generated by the reaction.

The hydrocarbyl substituent of the hydrocarbyl-substituted hydroxy aromatic compound can have a number average molecular weight and be derived from a polyolefin as described above for the hydrocarbyl substituent of the reaction product of the hydrocarbyl-substituted acylating agent and amine. In an embodiment of the invention the hydrocarbyl substituent of the hydrocarbyl-substituted hydroxy aromatic compound is derived from a polyisobutylene. The hydroxy aromatic compound can comprise phenol, a polyhydroxy benzene such as catechol, an alkyl-substituted phenol such as ortho-cresol, an alkyl-substituted polyhydroxy benzene such as 3-methylcatechol, or mixtures thereof. The hydrocarbyl-substituted hydroxy aromatic compound can be prepared by well known alkylation methods generally involving alkylation of the hydroxy aromatic compound with a polyolefin in the presence of acidic catalyst. The acidic catalyst can include for example mineral acids such as a sulfuric acid acidified clay, Lewis acid catalysts such as a complex of boron trifluoride with diethyl ether or with phenol, and acidic ion exchange resins such as the Amberlyst® series of strongly acidic macroreticular resins available from Rohm and Haas. In an embodiment of the invention phenol is alkylated with a conventional polyisobutylene, a highly reactive polyisobutylene or a mixture of conventional and highly reactive polyisobutylenes in the presence of a solvent or diluent and a $BF_3$ etherate catalyst between 0 and 50° C. as described in U.S. Pat. No. 5,876,468.

The Mannich reaction product of the present invention can comprise the reaction product of a hydrocarbyl-substituted hydroxy aromatic compound, an aldehyde and an amine that contains at least one amino group with a reactive nitrogen to hydrogen or N—H bond. The hydrocarbyl substituent of the Mannich reaction product can have a number average molecular weight and be derived from a polyolefin as described above for the hydrocarbyl substituent of the reaction product of the hydrocarbyl-substituted acylating agent and amine. In an embodiment of the invention the hydrocarbyl substituent of the Mannich reaction product is derived from a polyisobutylene, and in other embodiments is derived from a conventional polyisobutylene having a vinylidene isomer content of 25 mole % or less, from a highly reactive polyisobutylene having a vinylidene isomer content of 50 mole % or greater, or from a mixture of a conventional polyisobutylene and a highly reactive polyisobutylene. The hydroxy aromatic compound of the Mannich reaction product can be phenol, an alkylated phenol such as o-cresol, a polyhydroxy benzene such as catechol, an alkylated polyhydroxy benzene such as 3-methylcatechol, or mixtures thereof. In an embodiment of the invention the hydroxy aromatic compound is phenol, and in other embodiments is o-cresol, or a mixture of phenol and o-cresol. The hydrocarbyl substituted hydroxy aromatic compound of the Mannich reaction product can be prepared by well known alkylation methods as described above for the hydrocarbyl substituted hydroxy aromatic compound detergent/dispersant additive. The aldehyde of the Mannich reaction product can be an aldehyde having 1 to 6 carbon atoms. In an embodiment of the invention the aldehyde is formaldehyde or a reactive equivalent thereof to include formalin and paraformaldehyde. The amine of the Mannich reaction product has at least one reactive amino group that has at least one reactive nitrogen to hydrogen or N—H bond capable of undergoing a Mannich reaction. The amine can be a monoamine, a polyamine containing two or more amino groups, or a mixture thereof. The monoamine can comprise ammonia, a primary amine, a secondary amine, or a mixture thereof. The primary and secondary amine can include alkanolamines that have one or more hydroxyalkyl groups. The monoamine can include for example butylamine, dimethylamine, ethanolamine and diethanolamine. The polyamine can comprise an unsubstituted and/or substituted alkylenediamine, a polyalkylene polyamine, an alkanolamine containing one or more hydroxyalkyl groups, or a mixture thereof. The polyamine can include for example ethylenediamine, N-ethylethylenediamine, propylenediamine, diethylenetriamine, polyethylene polyamine bottoms, and 2-(2-aminoethylamino)ethanol. In embodiments of the invention the amine is ethylenediamine, dimethylamine, diethanolamine, or a mixture thereof. The Mannich reaction product can be prepared by well known methods generally involving reacting the hydrocarbyl substituted hydroxy aromatic compound, an aldehyde and an amine at temperatures between 75 to 200° C. in the presence of a solvent or diluent while removing reaction water as described in U.S. Pat. No. 5,876,468.

The detergent/dispersant additive of this invention can be present in a fuel composition on a weight basis at 1 to 10,000 ppm (parts per million), and in other embodiments can be present at 10 to 1,000 ppm, at 20 to 600 ppm, or at 30 to 300 ppm.

Liquid Fuel

The fuel composition of the present invention comprises a liquid fuel and is useful in fueling an internal combustion engine. The liquid fuel is normally a liquid at ambient conditions. The liquid fuel can be a hydrocarbon fuel, a nonhydrocarbon fuel, or a mixture thereof. The hydrocarbon fuel can be a petroleum distillate to include a gasoline as defined by ASTM specification D4814 or a diesel fuel as defined by ASTM specification D975. In an embodiment of the invention the liquid fuel is a gasoline, and in other embodiments the liquid fuel is a leaded gasoline, or a nonleaded gasoline. In another embodiment of this invention the liquid fuel is a diesel fuel. The hydrocarbon fuel can be a hydrocarbon prepared by a gas to liquid process to include for example hydrocarbons prepared by a process such as the Fischer-Tropsch process. The nonhydrocarbon fuel can be an oxygen containing composition, often referred to as an oxygenate, to include an alcohol, an ether, a ketone, an ester of a carboxylic acid, a nitroalkane, or a mixture thereof. The nonhydrocarbon fuel can include for example methanol, ethanol, methyl t-butyl ether, methyl ethyl ketone, transesterified oils and/or fats from plants and animals such as rapeseed methyl ester and soybean methyl ester, and nitromethane. Mixtures of hydrocarbon and nonhydrocarbon fuels can include for example gasoline and methanol and/or ethanol, diesel fuel and ethanol, and diesel fuel and a transesterified plant oil such as rapeseed methyl ester. In an embodiment of the invention the liquid fuel is an emulsion of water in a hydrocarbon fuel, a nonhydrocarbon fuel, or a mixture thereof. In several embodiments of this invention the liquid fuel can have a sulphur content on a weight basis that is 5000 ppm or less, 1000 ppm or less, 300 ppm or less, 200 ppm or less, 30 ppm or less, or 10 ppm or less. The liquid fuel of the invention is present in a fuel composition in a major amount that is generally greater than 50% by weight, and in other embodiments is present at greater than 90% by weight, greater than 95% by weight, greater than 99.5% by weight, or greater than 99.8% by weight.

Additional Performance Additives and Concentrates and Fuel Compositions

The fuel composition of the present invention can further comprise one or more additional performance additives. Additional performance additives can be added to a fuel composition depending on several factors to include the type of internal combustion engine and the type of fuel being used in that engine, the quality of the fuel, and the service conditions under which the engine is being operated. The additional performance additives can include an antioxidant such as a hindered phenol or derivative thereof and/or a diarylamine or derivative thereof, a corrosion inhibitor such as an alkenylsuccinic acid, a supplemental detergent/dispersant additive such as a polyetheramine, a cold flow improver such as an esterified copolymer of maleic anhydride and styrene and/or a copolymer of ethylene and vinyl acetate, a foam inhibitor such as a silicone fluid, a demulsifier such as a polyalkoxylated alcohol, a lubricity agent such as a fatty carboxylic acid, a metal deactivator such as an aromatic triazole or derivative thereof, a valve seat recession additive such as an alkali metal sulfosuccinate salt, a biocide, an antistatic agent, a deicer, a fluidizer such as a mineral oil and/or a poly(alpha-olefin) and/or a polyether, and a combustion improver such as an octane or cetane improver. The additional performance additive or additives can each be present on a weight basis in a fuel composition from 0.01 to 10,000 ppm, and in other embodiments can be present at 0.1 to 5,000 ppm, at 0.1 to 1,000 ppm, or at 0.1 to 500 ppm. The detergent/dispersant additive and the additional performance additives can each be added directly to a fuel composition, but they are generally added together in an additive concentrate composition to a fuel composition. The additive concentrate composition can comprise a solvent and the detergent/dispersant additive, and in another embodiment can further comprise one or more additional performance additives. The solvent can be an aliphatic hydrocarbon, an aromatic hydrocarbon, an oxygen containing composition, or a mixture thereof. The oxygen containing composition can include an alcohol, a ketone, an ester of a carboxylic acid, a glycol and/or a polyglycol, or a mixture thereof. The solvent in an embodiment of the invention will be substantially free of to free of sulphur having a sulphur content in several instances that is below 25 ppm, below 18 ppm, below 10 ppm, below 8 ppp, below 4 ppm, or below 2 ppm. The solvent can be present in the additive concentrate composition at 1 to 99% by weight, and in other instances at 3 to 80% by weight, or 10 to 70% by weight. The detergent/dispersant additive and additional performance additives taken separately or in combination can be present in the additive concentrate composition at 0.01 to 95% by weight, and in other instances can be present at 0.01 to 90% by weight, at 0.01 to 85% by weight, or at 0.1 to 80% by weight. In an embodiment of the invention the solvent of the additive concentrate composition can include the medium substantially free of to free of sulphur as described in this application. In an embodiment of the invention the fuel composition is substantially free of or free of at least one member selected from the group consisting of sulphur, phosphorus, sulfated ash, and combinations thereof, and in other embodiments the fuel composition contains less than 20 ppm, less than 15 ppm, less than 10 ppm, or less than 1 ppm of one of these members. In an embodiment of the invention the additive concentrate composition or fuel composition can be prepared by admixing or mixing the components of the composition at ambient to elevated temperatures usually up to 60° C. until the composition is homogeneous.

Process for Fuel Composition and for Increasing Efficiency of Exhaust After-Treatment Device In an embodiment of the invention a process for preparing a fuel composition comprises (1) mixing (a) a medium substantially free of to free of sulphur and (b) a detergent/dispersant additive precursor where the precursor is a hydrocarbyl-substituted acylating agent to form a mixture; (2) reacting component (b) of the mixture with a functionalizing reactant or reactants where the functionalizing reactant is an amine to form a detergent/dispersant additive; and (3) adding a liquid fuel to the mixture during step (1), to the reactants during step (2), to the detergent/dispersant additive after step (2), or a combination thereof wherein the medium substantially free of to free of sulphur is an aliphatic hydrocarbon solvent, and the aliphatic hydrocarbon solvent is present from at least about 50 wt % to about 100 wt % of the total amount of the medium. In another embodiment of the invention the liquid fuel is added after step (2). The mixture of the detergent/dispersant additive precursor such as the hydrocarbyl-substituted acylating agent and the medium of step (1) of the process can be formed by mixing the 2 components at ambient to elevated temperatures to include in several instances from 20 to 200° C., from 55 to 165° C., or from 90 to 130° C. for generally 15 minutes to an hour or until homogeneous. Step (2) of the process to form the detergent/dispersant additive from the detergent/dispersant additive precursor and functionalizing reactant or reactants such as the hydrocarbyl-substituted acylating agent and amine is generally carried out at temperatures between 20 to 220° C. depending on the additive being formed and for 1 or more hours until the reaction is substantially complete by being more than 50% reacted or more than 60% reacted or more than 70% reacted. For the additive formed from the hydrocarbyl-substituted acylating agent and amine the temperature for the reaction to form the additive can be between 100 to 220° C. or between 120 to 200° C. or between 130 to 180° C. When the reaction to form the detergent/dispersant additive generates a volatile by-product, the reaction can be run at a reduced pressure below the atmospheric pressure to facilitate removal of the by-product and completion of the reaction. For the reaction to form the reaction product of the hydrocarbyl substituted acylating agent and amine or to form the Mannich reaction product where water can be generated as a by-product, the pressure can be reduced to 50.7 kPa (kilopascals) or less, and in other instances can be reduced to 25.3 kPa or less, 12.7 kPa or less, or 6 kPa or less. The process to prepare the reaction product of the hydrocarbyl-substituted acylating agent and amine is further described and illustrated in the examples hereinbelow.

The invention further provides a process for increasing the efficiency of an exhaust after-treatment device of an internal combustion engine, comprising operating the engine with a fuel composition comprising (a) a detergent/dispersant additive in a medium substantially free of to free of sulphur, and (b) a liquid fuel wherein the contribution of component (a) to the total sulphur content of the fuel composition is less than about 20 ppm by weight, and the exhaust after-treatment device is suitable for reducing emissions of at least one member of the group consisting of particulate matter, $NO_x$ gases, and mixtures thereof to less than about 600 ppm by weight. In several embodiments of the invention the detergent/dispersant additive in a medium can be prepared in that medium; can be prepared in the absence of a medium and then added to a medium; or can be prepared in a first medium, separated from the first medium, and added to a second medium. In a further embodiment of the process for increasing the efficiency of the exhaust after-treatment device, the exhaust after-treatment device is suitable for reducing the emissions of $NO_x$ gases. In an embodiment of the process for increasing efficiency of the exhaust after-treatment device the medium substantially free of to free of sulphur can be a hydrocarbon, a nonhydrocarbon, or a mixture thereof. The hydrocarbon can be an aliphatic hydrocarbon, an aromatic hydrocarbon or a mixture thereof as described throughout this application to include an oil of lubricating viscosity, a petroleum distillate, an alkane, an alkene, or a mixture thereof. The nonhydrocarbon can be an alcohol, a glycol, a polyglycol, an ether, an aldehyde, a ketone, an ester of a carboxylic acid, or a mixture thereof. In an embodiment of the invention the process for increasing efficiency of an after-treatment device involves a medium selected from the group consisting of an aromatic hydrocarbon solvent, an aliphatic hydrocarbon solvent and mixtures thereof. In a further embodiment of the invention the medium substantially free of to free of sulphur is an aliphatic hydrocarbon solvent where the aliphatic hydrocarbon solvent is present from 50 or 60 or 70 or 80 or 90 to 100 weight % of the total amount of the medium. In several embodiments of the invention the contribution of component (a) to the total sulphur content of the fuel composition is on a weight basis less than about 20 ppm, less than about 15 ppm, less than about 10 ppm, less than about 6 ppm, less than about 2 ppm, or less than about 1 ppm. In several embodiments of the invention the exhaust after-treatment device is suitable for reducing emissions on a weight basis of at least one of the group consisting of particulate matter, $NO_x$ gases, and mixtures thereof to less than about 600 ppm, less than about 400 ppm, less than about 200 ppm, less than about 100 ppm, less than about 50 ppm, or less than about 25 ppm.

The exhaust after-treatment device of the present invention is capable of reducing emissions from an internal combustion engine comprising particulate matter, $NO_x$, or a mixture thereof. The exhaust after-treatment device can comprise a three-way catalyst which is normally used on a spark-ignited engine. The exhaust after-treatment device can comprise one or more of several devices to include the three-way catalyst and devices which are normally used on a compression-ignited engine to include a diesel oxidation catalyst, a catalyzed diesel particulate filter, a catalyst that reduces $NO_x$ to include a selective catalytic reduction catalyst which uses ammonia to reduce $NO_x$ and a lean $NO_x$ catalyst which uses hydrocarbons from the fuel to reduce $NO_x$, or a combination thereof. The exhaust after-treatment devices are generally available from several companies and include Engelhard and Johnson Matthey.

INDUSTRIAL APPLICATION OF THE INVENTION

The fuel composition and process for increasing the efficiency of an exhaust after-treatment device of the present invention are useful in providing both fuel system cleanliness and improved exhaust emissions performance in an internal combustion engine. The internal combustion engine can be a gasoline engine to include a direct injection gasoline engine or a diesel engine to include both light duty and heavy duty diesel engines.

The following examples provide an illustration of the invention. These examples are nonexhaustive and are not intended to limit the scope of the invention.

EXAMPLES

Preparative Example 1a

Pilot™ 900 (320 g of an aliphatic hydrocarbon substantially free of sulphur) and a polyisobutenylsuccinic anhydride (746 g and derived from a polyisobutylene having a number average molecular weight of about 1,000) are charged to a reactor and heated whilst stirring the mixture to 110° C. over 2 hours. The resulting mixture is filtered through a sintered filter funnel to give Preparative Example 1a product.

Preparative Example 1b

Preparative Example 1a (476 g of a mixture of Pilot 900 ® and a polyisobutenylsuccinic anhydride in a 30 to 70 weight ratio) is charged to a reactor and heated while stirring the material to about 150° C. Tetraethylenepentamine (66 g) is charged to the reactor dropwise over 1 hour. The reactants are heated to 175° C. for 4 hours giving the final product which based on analysis has a carbonyl to nitrogen ratio of 1:1.8.

NOx Emission Evaluations

Example 1 (Comparative)

An additive composition is prepared in a synthetic poly (alpha-olefin) diluent that contains 14.3% by weight of a polyisobutenylsuccinimide composition in a high sulphur content diluent oil, and 2.3% by weight of several other additives which are a viscosity modifier, antioxidants, a foam inhibitor, and a diluent oil. The additive composition has a sulphur content of 272 ppm by weight.

Example 2

An additive composition is prepared that is identical to the additive composition of Example 1 except that the diluent oil used in the polyisobutenylsuccinimide composition and in the additive composition is substantially free of sulphur. The additive composition has a sulphur content of 11 ppm by weight.

Example 3

An additive composition is prepared that is identical to Example 2 above except that the polyisobutenylsuccinimide composition is the product of Preparative Example 1b above. The additive composition is substantially free of sulphur.

2.3 Liter Ford Engine Test

A 2.3 liter Ford engine equipped with a three-way catalyst exhaust after-treatment device is run for 280 hours on a gasoline fuel composition that contains either 0.5% by weight of the additive composition of Example 1 or Example 2. The $NO_x$ exhaust emissions for each gasoline fuel composition are measured over the 280 hours using a Horiba Mexa 7100™ exhaust gas analyzer both before and after passing through the three-way catalyst. The $NO_x$ exhaust emissions results are presented in the table and show an unexpected and significant benefit of increasing the efficiency of an exhaust after-treatment device by using a medium in conjunction with a detergent/dispersant additive that is substantially free of to free of sulphur.

| Fuel + 0.5% Example | $NO_x$ Emissions before catalyst (ppm) | $NO_x$ Emissions after catalyst (ppm) | Comments |
|---|---|---|---|
| Example 1[a] (comparative) | About 3000-3200 | Increasing up to 3000 after about 140 hours | Catalyst working less efficiently after 5 hours |
| Example 2[b] | About 3000-3500 | 0 to about 10 after about 280 hours | Catalyst still working efficiently after test finished |

[a]The fuel composition containing Example 1 has a total sulphur content of 29.2 ppm.
[b]The fuel composition containing Example 2 has a total sulphur content of 27.9 ppm.

While the invention has been explained, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for increasing the efficiency of an exhaust after-treatment device of an internal combustion engine, comprising:

operating the engine with a fuel composition comprising (a) a detergent/dispersant additive in a medium substantially free of to free of sulphur; and (b) a liquid fuel;

wherein the contribution of component (a) to the total sulphur content of the fuel composition is less than about 20 ppm by weight, and the exhaust after-treatment device is suitable for reducing emissions of at least one member of the group consisting of particulate matter, $NO_x$ gases, and mixtures thereof to less than about 600 ppm by weight; and wherein the medium substantially free of to free of sulphur comprises an aliphatic hydrocarbon solvent having a flashpoint of about 120° C. or higher; and wherein the composition does not contain an emulsified fuel.

2. The process of claim 1 wherein the contribution of component (a) to the total sulphur content of the fuel composition is less than about 15 ppm by weight.

3. The process of claim 1 wherein the contribution of component (a) to the total sulphur content of the fuel composition is less than about 6 ppm by weight.

4. The process of claim 1 wherein the exhaust after-treatment device is a three-way catalyst, a diesel oxidation catalyst, a catalysed diesel particulate filter, a catalyst that reduces $NO_x$, or a combination thereof.

5. The process of claim 1 wherein the emissions of at least one member of the group consisting of particulate matter, $NO_x$ gases and mixtures thereof is less than about 400 ppm by weight.

6. The process of claim 1 wherein the emissions of at least one member of the group consisting of particulate matter, $NO_x$ gases and mixtures thereof is less than about 100 ppm by weight.

7. The process of claim 1 wherein the fuel liquid is selected from the group consisting of gasoline, diesel fuel, a hydrocarbon fuel prepared by a gas to liquid process, an alcohol, an ether, a ketone, an ester of a carboxylic acid, a nitroalkane, a transesterified oil and/or fat from a plant or animal, or combinations thereof.

8. The process of claim 1, wherein the aliphatic hydrocarbon solvent is present from at least about 50 wt % to about 100 wt % of the total amount of the medium.

9. The process of claim 1, wherein the aliphatic hydrocarbon solvent is present from at least about 80 wt % to about 100 wt % of the total amount of the medium.

10. The process of claim 1, wherein the medium substantially free of to free of sulphur further comprises an aromatic hydrocarbon solvent, a petroleum distillate, or combinations thereof.

* * * * *